US005195936A

United States Patent [19]

Mao

[11] Patent Number: 5,195,936

[45] Date of Patent: Mar. 23, 1993

[54] EXERCISE DEVICE HAVING FLUID RESISTANCE

[75] Inventor: Chien-Kao Mao, Taipei, Taiwan

[73] Assignee: Gemini Mercantile Inc., Taipei, Taiwan

[21] Appl. No.: 805,262

[22] Filed: Dec. 9, 1991

[51] Int. Cl.[5] ..... A63B 22/06; A63B 69/16

[52] U.S. Cl. ..... 482/112; 482/58

[58] Field of Search ..... 482/112, 63, 57, 58, 482/113

[56] References Cited

U.S. PATENT DOCUMENTS 4,171,802 10/1979 Stoecker ..... 482/112
4,645,199 2/1987 Bloemendaal ..... 482/58
4,741,529 5/1988 Bloemendaal ..... 482/112

*Primary Examiner*—Stephen R. Crow
*Attorney, Agent, or Firm*—Ddykema Gossett

[57] ABSTRACT

Disclosed is an energy absorbing device for gymnastic exercisers, which utilizes a vaned wheel for swirling fluid so as to apply resisting forces on the exerciser. A load adjusting device is used for adjusting the resisting force by adjusting the amount of fluid. The resisting force increases with the rotational speed of the vaned wheel. Two vaned side plates enclose the vaned wheel and fluid.

7 Claims, 5 Drawing Sheets

EXERCISE DEVICE HAVING FLUID RESISTANCE

FIELD OF THE INVENTION

The present invention relates to an energy absorbing device, especially to an energy absorbing device for gymnastic exercisers.

BACKGROUND OF THE INVENTION

Gymnastic exercisers commonly utilized in homes or exercising rooms, including stationary bicycles and climbing exercisers, etc., have energy absorbing devices therein, which are adapted to be driven by an exercising person via power transmission systems, for converting the mechanical energy generated by the exercising person into heat. Therefore, the exercising person can exercise in a small place, yet still get enough exercising effect. This kind of gymnastic exercisers is compact and convenient, and, different exercising effects can be achieved by different power transmission system.

There are different types of energy absorbing devices, which include: 1) the friction type, which usually has a flywheel with a friction belt wraped thereon. The friction force can be adjusted. Some examples of this type are disclosed in U.S. Pat. No. 3995491 to Wolfla, II, and U.S. Pat. No. 4533136 to Smith et al. 2) the vaned type, disclosed in U.S. Pat. No. 4188030 to Hooper, which drives a large vaned wheel via gears and sprockets, to absorb energy by movement of the broad surfaces of the vanes against the surrounding body of air. The friction force can not be adjusted.

The two types of energy absorbing devices as listed above have deficiencies respectively. The friction force of the friction type is a constant value, and the static friction force is larger than the dynamic friction force. As a result, the exercising person feels its hard to start, but the friction force can not be increased when the rotating speed is high, thus diminishing the exercising effect. If the friction force is raised to increase the exercising effect, the wheel can hardly be started by the exercising person. Furthermore, the exercising effect of this type is not satisfactory. Besides, when the friction belt is worn out, the user can rarely find a replacement, which make the entire exerciser useless. Other shortcomings include: the exerciser is difficult to move due to the heavy flywheel, and the high frequency noises emitted because of friction between the friction belt and the flywheel are difficult to bear.

The friction force of the vaned type increases along with the rotating speed of the vanes. Therefore, the exercising effect is greater than that of the friction type. The vaned type does not have the shortcomings of being hard to start and of the friction belt wearing. But, the vaned wheel will generate unbearable noises. In addition, the side effects of the cold wind create problems for the exercising user when the device is used in cold regions or during cold seasons. Other disadvantages of the vaned type include its tremendous size, and the unadjustable resisting force.

SUMMARY OF THE INVENTION

It is therefore an object of the present invention to provide a damper for gymnastic exercisers, which can give an user adequate exercising effects. Other objects of the present invention include: ease of starting, an increase in the resisting force with the rotating speed of the damper, no wear, low noise, no wind, compact size, and adjustable resisting force.

The basic principle of the present invention is introduced hereinafter. Fluid, such as water, is enclosed in the damper. A rotating plate is enclosed in the damper too, and driven by the user via mechanisms of the exerciser. Fluid in the damper is swirled by a vaned rotating plate, and thus absorbs the mechanical energy. Because the resisting force of fluid increases with the rotational speed of the rotating plate and there is no resisting force when the fluid is still, the present invention is easy to start and the resisting force of the damper increases with the speed to rotation.

The further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE FIGURES

The present invention will become more fully understood from the detailed description given hereinbelow and the accompanying drawings which are given by way of illustration only, and thus are not limitative of the present invention and wherein.

DETAILED DESCRIPTION OF THE PREFERRED EMBODIMENT

Figure 1:
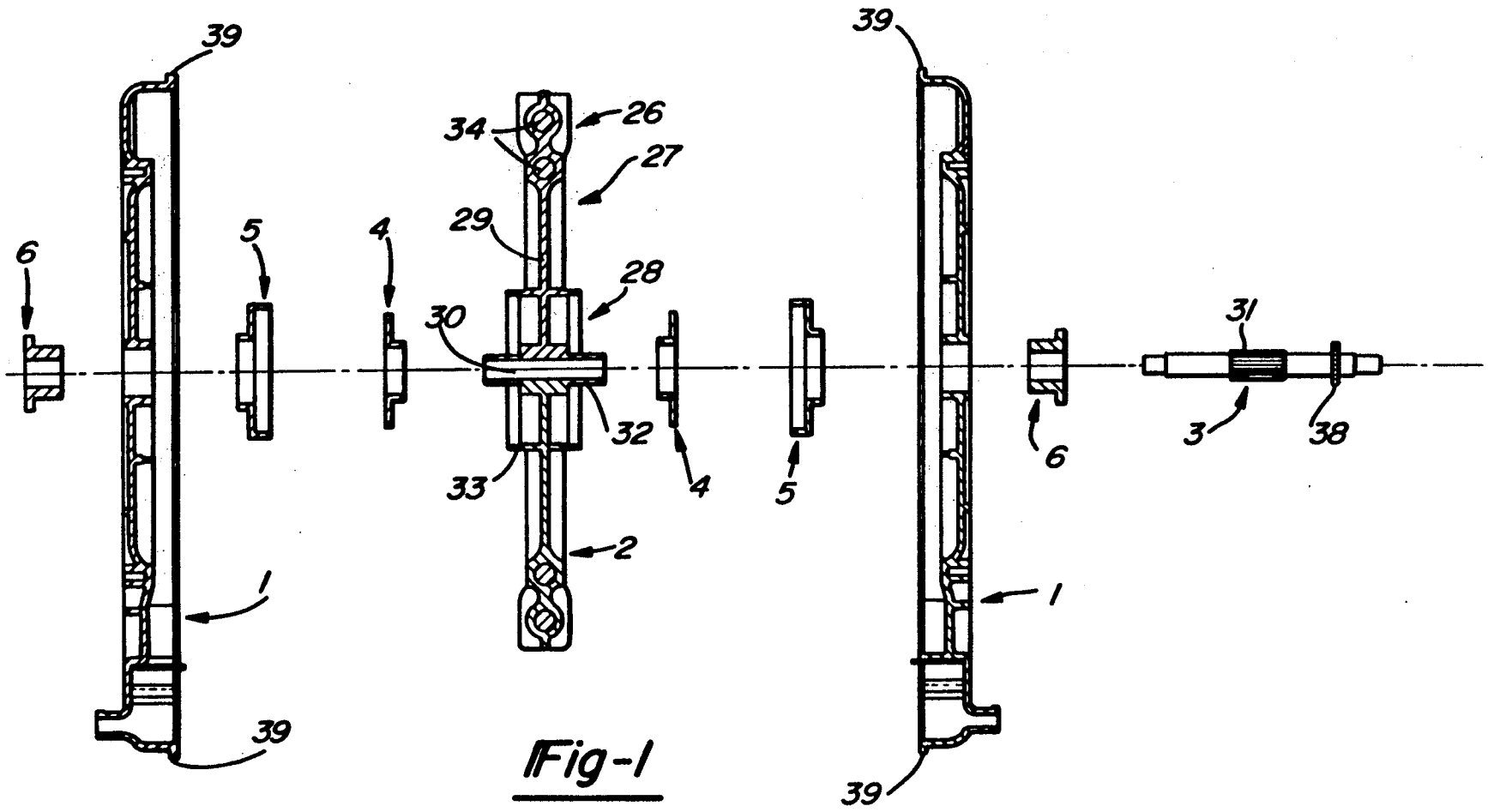
FIG. 1 is an exploded cross-sectional view of the first embodiment of the present invention.
Figure 2:
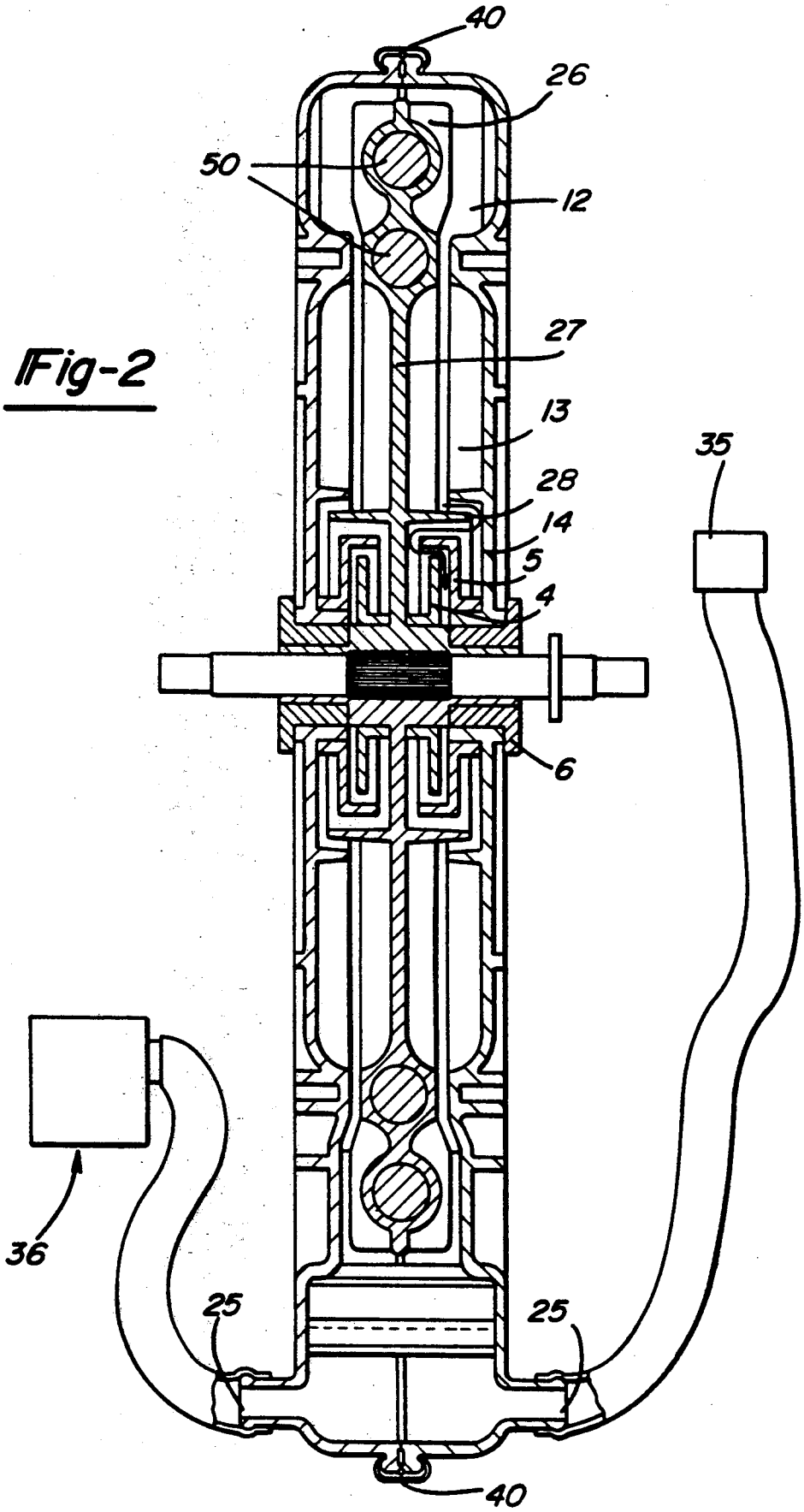
FIG. 2 is a cross-sectional view of the first embodiment of the present invention.

Please refer to FIG. 1. The first embodiment of the present invention includes two side plates 1, a rotating plate 2, a shaft 3, two first partition plates 4, two second partition plates 5, and two tabs 6. FIG. 2 shows the first embodiment after assembly. Two side plates form a closed space having fluid (e.g. water) therein. The movement of the user drives shaft 3 to rotate via mechanisms of the exerciser. Shaft 3 drives rotating plate 2 to rotate relative to side plates 1. The fluid enclosed in the side plates is swirled by vaned rotating plate 2 and vaned side plates 1. The mechanical energy comes from the exercising person is subsequently transformed into heat in the fluid. As is known from fluid dynamics, there is no viscosity when the fluid speed is zero. Hence, there is no starting resistance, and it is easy for the exercising person to start. The resisting force comes from the swirling action of the fluid, which substantially increases with the rotational speed of the rotating plate 2 smoothly. There is no wear, because there is no friction between any parts. As been compared to friction type and vaned type energy absorbing devices, the damper according to the present invention emits few noises, is compact in size, and has no wind problems like the vaned type.

Figure 5:
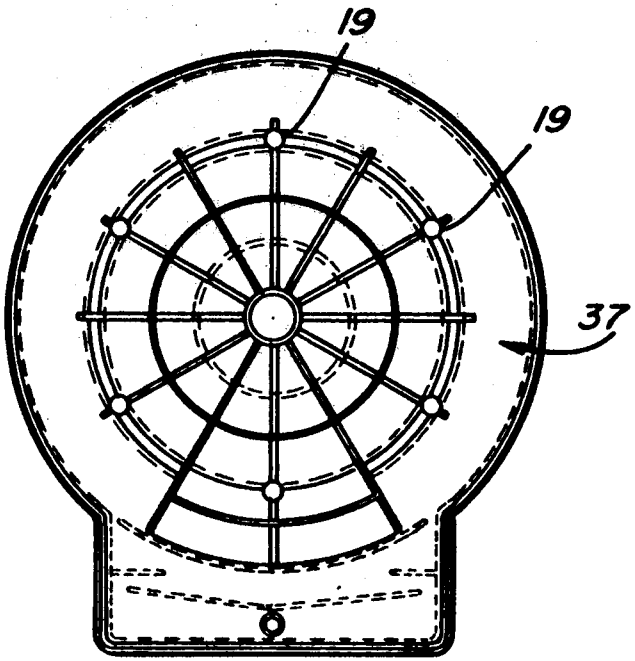
FIG. 5 is a rear-end view of a side plate of the first embodiment of the present invention.
Figure 4:
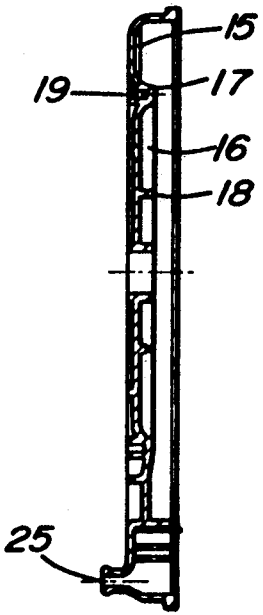
FIG. 4 is a cross-sectional view of a side plate of the first embodiment of the present invention.
Figure 3:
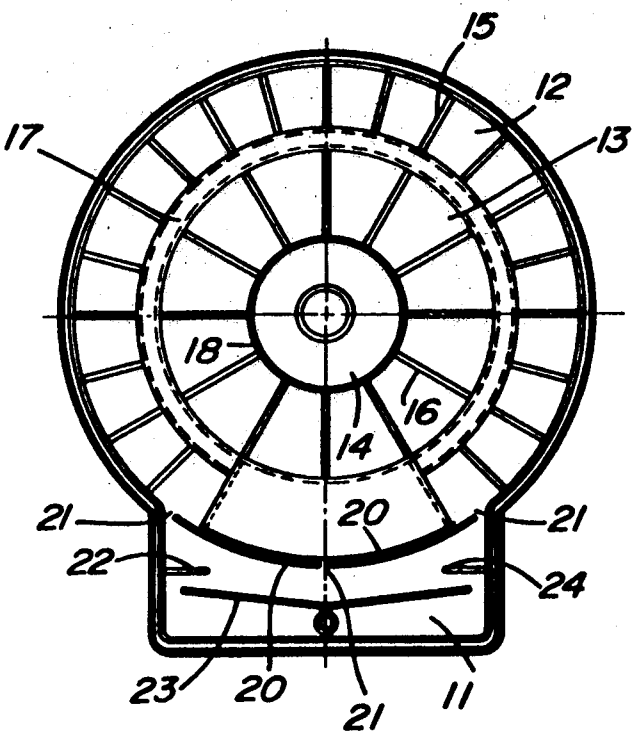
FIG. 3 is a front view of a side plate of the first embodiment of the present invention.

Now refer to FIGS. 3, 4, and 5. Side plate 1 is substantially a disk. The lower portion of the side plate 1 forms a square space, i.e., a fluid storing chamber 11. The space inside the side plate 1 is substantially divided into three portions: an outer tubular chamber 12, an inner tubular chamber 13, and a central portion 14. The outer tubular chamber 12 and the inner tubular chamber 13 are provided with a plurality of vanes 15 and 16. The fluid will swirl between the vanes when said fluid is driven to flow in the outer tubular chamber 12, resulting in a substantial resisting force. Vanes 16 assists in propelling the fluid in the inner tubular chamber 13 out to the outer tubular chamber 12, so as to reduce the amount of fluid flowing down into the central portion 14. As shown in FIG. 2, the central portion 14 accommodates the first partition plate 4 and the second partition plate 5, to form an labyrinth therein. In such an arrangement, when the fluid flows down into the central portion 14, said fluid will exit from the lower edge of the central portion 14, and then flow down into the inner tubular chamber 13. After that, said fluid enters the outer tubular chamber 12 again and recycles. Consequently, said fluid will not leak out from a gap between the shaft 3 and the side plate 1. A tubular partition plate 18 is provided between the central portion 14 and the inner tubular chamber 13. A tubular partition plate 17 is provided between the inner tubular chamber 13 and the outer tubular chamber 12. Partition plate 17 is provided with 6 mounting holes on the outer side of the side plate 1, for mounting the damper on the exerciser with screws.

Fluid storing chamber 11 is formed in the lower portion of the side plate 1 to accumulate fluid. A partition plate 20 is provided between the fluid storing chamber 11 and the outer tubular chamber 12. There are notches 21 at two ends and the center of the partition plate 20 to provide passages between the fluid storing chamber 11 and the outer tubular chamber 12. Fluid storing chamber 11 is provided with partition plates 22, 23, and 24 to form a labyrinth therein. When the rotating plate 2 rotates, the fluid is driven to swirl and forms a mixture of fluid and bubbles. The mixture is driven by centrifugal force into fluid storing chamber 11 by way of notches 21. Because the rotating plate has no effect on the fluid in the fluid storing chamber 11, there is no swirling in the fluid storing chamber 11. When the mixture enters the fluid storing chamber 11, bubbles and fluid separate automatically. The bubbles are blocked by partition plates 22, 23, and 24. Then said bubbles float upwardly and enter the outer tubular chamber 12 via notches 21. Thus the fluid storing chamber 11 functions like a gasliquid separating room. An opening 25 is provided near the bottom of the side wall of the fluid storing chamber 11. Fluid can either enter or leave the fluid storing chamber 11. Another function of the fluid storing chamber 11 is to adjust the amount of fluid in the inner tubular chamber and the outer tubular chamber, for maintaining a constant volume of fluid in the outer tubular chamber, thus avoiding variation of the resisting force due to a change in the amount of fluid in the outer tubular chamber.

Figure 6:
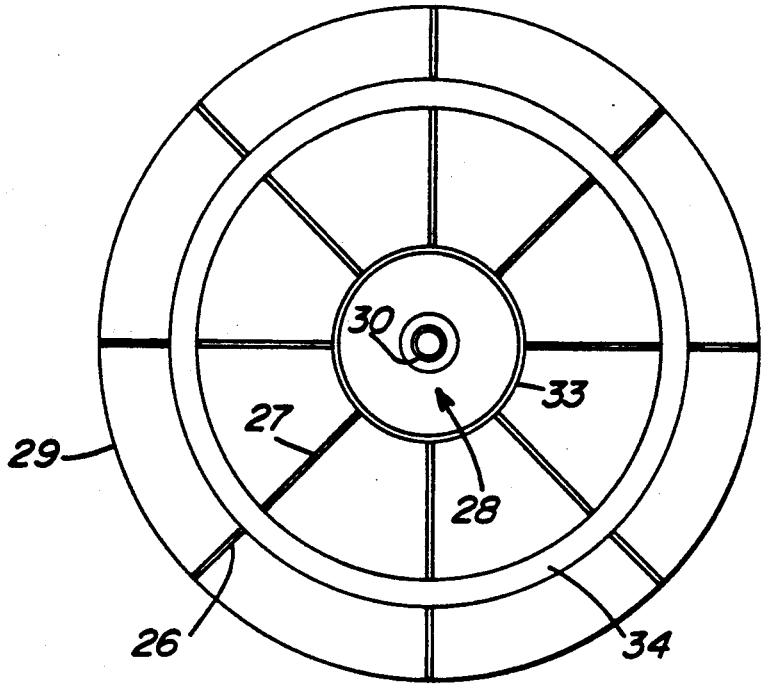
FIG. 6 is a front view of a rotating plate of the first embodiment of the present invention.

FIGS. 1 and 6 show the structure of the rotating plate 2. Rotating plate 2 is a symmetrical disk, including three major portions: an outer vaned wheel 26, an inner vaned wheel 27, and a central portion 28. The three portions of the rotating plate are integrally formed with a disk 29. The outer vaned wheel 26 urges the fluid to rotate and swirl in the outer tubular chamber 12 and the outer vaned wheel 26. The fluid applies resisting forces on the rotating plate 2 while swirling. The resisting force increases with the swirling speed of the fluid. As a result, the resisting force is high when the rotating plate 2 rotates fast, and vice versa. There is almost no resisting force when the fluid is still.

The inner vaned wheel 27 repels the fluid in the inner tubular chamber 13 out into the outer tubular chamber 12 with the help of vanes 16, and thus reduces the amount of fluid flowing down into the central portion 14 and 28. At the same time, the inner vaned wheel 27 and the vanes 16 cause the fluid to swirl, thus providing a resisting force against the outer vaned wheel 26 and the vanes 15. As shown in FIG. 2, the central portion 28 and the central portion 14 together forms a tubular chamber for accommodating the first partition plate 4 and the second partition plate 5 to construct a labyrinth therein. In such an arrangement, when fluid flows down into the central portion 14 and 28, said fluid is stopped by the first partition plate 4 and the second partition plate 5, exits from the lower edge of the central portion 14 and 28 and then flows down into the inner tubular chamber 13. After that, said fluid enters the outer tubular chamber 12 again and recycles. Consequently, the present invention sufficiently avoids leakages without utilizing conventional seals and close fittings. It should be noted that, tabs 6 are not seals. In experiments, the inventor found that almost all the fluid rotates and swirls in the outer tubular chamber 12 and the inner tubular chamber 13. Only a little fluid flows down into the central portion, but exits right away. As a conclusion, the labyrinth formed in the central portion serves the function of stopping leakage sufficiently.

Now referring to FIG. 1, a shaft hole 30 extends along the axial direction of the rotating plate 2 in its central portion to accommodate a metal shaft 3. The central portion of the shaft 3 is provided with splines (not shown) to drivingly engage with splines on the shaft hole 30 (not shown). Tabs 6 is mounted on the extending portions of the shaft hole 30 to eliminate the gaps between side plates 2 and the extending portions the shaft hole 30. A partition plate 33 is provided between the central portion 28 and the inner vaned wheel 27 to divide the central portion 28 and the inner vaned wheel 27. A partition plate 34 is provided between the outer vaned wheel 26 and the inner vaned wheel 27 to divide the outer vaned wheel 26 and the inner vaned wheel 27. Partition plate 34 and the middle portion of the outer vaned wheel 26 are enlarged and embedded with high density materials to increase the moment of inertia of the rotating plate 2. Thus, when the user stops momentarily, the rotating plate 2 will remain rotating for a while, avoiding a sudden stop. On the other hand, the moment of inertia of the rotating plate 2 provides the resisting force for a smooth start, because no resisting force comes from the fluid.

Shaft 3 is provided with a sprocket wheel 38 near its one end. The central portion of shaft 3 is provided with spline 31 to drivingly engage with the rotating plate 2. Two ends of the shaft 3 are supported by the exerciser via bearings (41). The sprocket wheel 38 is drivingly engaged with a chain (not shown) of the exerciser. The movement of the user is transferred into rotation to drive the sprocket wheel 38 via mechanisms like linkages or gears. These mechanisms are familiar to those skilled in the art.

Figure 7:
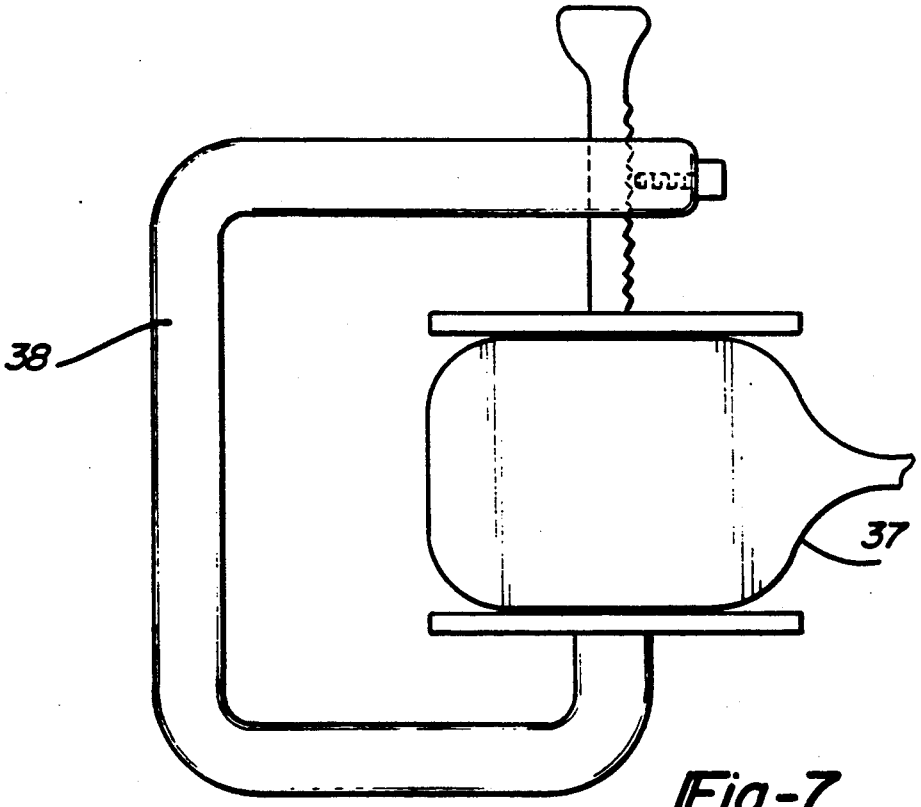
FIG. 7 is a side view of a load regulator of the first embodiment of the present invention.

The present invention further provides a load adjusting device for adjustment of the resisting force as needed by the user. Referring to FIG. 2, each side plate 2 has an opening 25. One of the openings 25 is connected to fluid inlet 35, the other is connected to the load adjusting device 36. The first time the user begins to use, he/she can connect the fluid inlet to a faucet or other fluid supplying means, and then fill the damper with water or other fluids. The level of the water or other fluids should be between the upper and the lower limits 37 which are marked on the side plate 2. The load adjusting device 36 is filled at the same time. When the user lifts up the load adjusting device 36, the fluid in the load adjusting device 36 flows into the damper, so that the resisting force increases. When the load adjusting device 36 is put down, the resisting force will decrease. Other adjusting means may be utilized to adjust the amount of fluid in the load adjusting device 36. For instance, FIG. 7 shows a clamping means 38 cooperating with a fluid bag 37. The user may tighten the clamping means 38 to propel the fluid into the damper and increase the resisting force, or loosen the clamping means 38 to decrease the resisting force.

FIG. 2 shows the assembled components of the damper. The contacting surfaces of the side plates are coated with adhesives, like silicon, to prevent leakage. The side plates are clamped by clamps 40.

Figure 8:
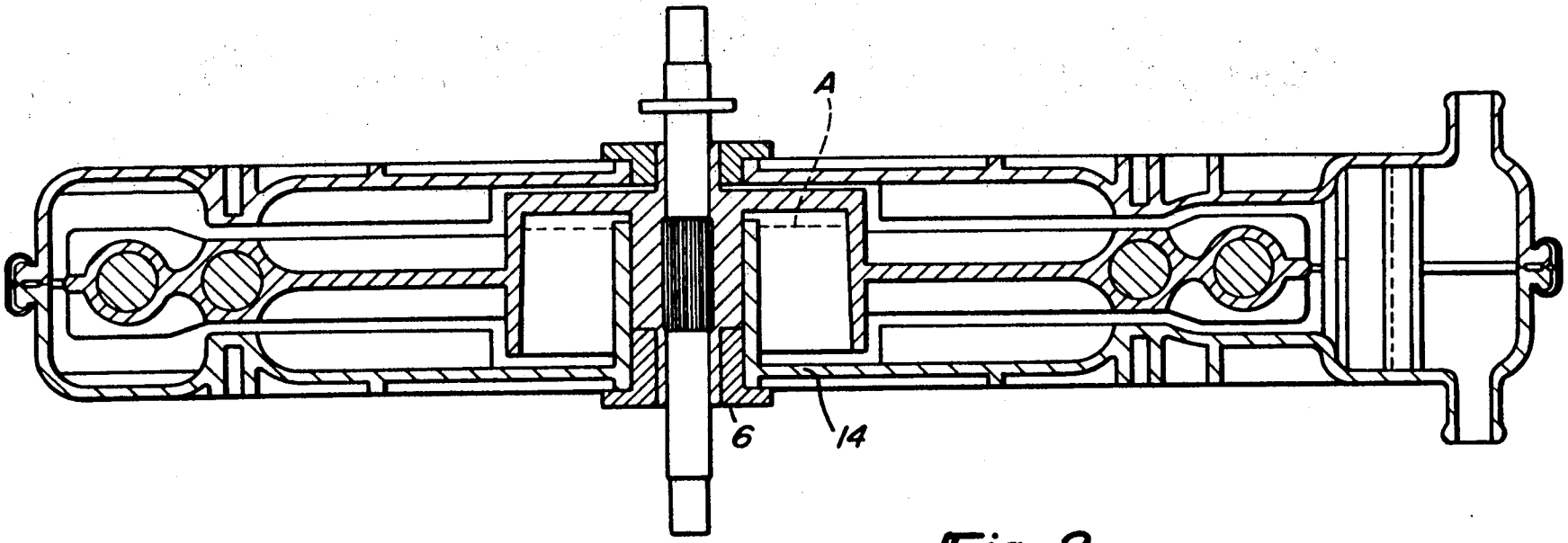
FIG. 8 is a cross-sectional view of the second embodiment of the present invention.

A second embodiment of the present is shown in FIG. 8, which is vertically positioned. The structure and principle of this embodiment is mostly the same as the first embodiment. Because the fluid is urged outwardly, there is less problem of leakage in the central portion. Consequently, the first partition plate and the second partition plate are omitted, and the central portions of the rotating plate and the side plates are modified as shown in FIG. 8 to prevent leakage. It should be noted that the level of the fluid must not exceed the phantom line A.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An energy absorbing device for gymnastic exercisers comprising:

(a) two side plates for forming a closed space therebetween, said side plates are vaned toward said closed space;

(b) a vaned rotating plate being capable of rotating inside said closed space; and (c) a shaft drivingly engaged with said rotating plate, said shaft having a sprocket wheel means engaged with a chain means driven by a user of the device, said shaft is capable of being urged to drive said rotating plate, wherein said side plates are capable of accommodating fluid therebetween, when said shaft is urged to drive said rotating plate to rotate in said closed space, said fluid is urged to swirl in said closed space and applies resisting forces on said rotating plate and said shaft, wherein said rotating plate includes two opposed faces which are generally perpendicular to an axis of rotation of said plate, and vanes extending axially and radially outwardly from said axis of rotation on at least one of said faces to impel said fluid.

2. An energy absorbing device as claimed in claim 1, further comprises:

at least one partition plate disposed between said side plates and said shaft to form a labyrinth for preventing leakage of said fluid.

3. An energy absorbing device as claimed in claim 1, wherein:

said rotating plate is weighted to increase the moment of inertia of said rotating plate.

4. An energy absorbing device as claimed in claim 1, further comprises:

a load adjusting device connected to said closed space, said load adjusting device is capable of accommodating fluid therein for adjusting the amount of fluid in said closed space by changing the position of said load adjusting device, so as to adjust the resisting force.

5. An energy absorbing device as claimed in claim 1, further comprises:

a load adjusting device connected to said closed space, said load adjusting device is capable of accommodating fluid therein; and a clamping means for adjusting the amount of fluid in said load adjusting device and said closed space, so as to adjust the resisting force.

6. An energy absorbing device as claimed in claim 1, further comprises:

at least one partition plate disposed between said side plates and said shaft to form a labyrinth for preventing leakage of said fluid;

a load adjusting device connected to said closed space, said load adjusting device is capable of accommodating fluid therein; and a clamping means for adjusting the amount of fluid in said load adjusting device and said closed space, so as to adjust the resisting force, wherein said rotating plate is weighted to increase the moment of inertia of said rotating plate.

7. An energy absorbing device as claimed in claim 1, wherein said fluid is water.

* * * * *